US010463148B2

(12) United States Patent
Gober

(10) Patent No.: US 10,463,148 B2
(45) Date of Patent: Nov. 5, 2019

(54) RADIANT FURNITURE

(71) Applicant: David A. Gober, Carthage, MO (US)

(72) Inventor: David A. Gober, Carthage, MO (US)

( * ) Notice: Subject to any disclaimer, the term of this patent is extended or adjusted under 35 U.S.C. 154(b) by 382 days.

(21) Appl. No.: 14/970,839

(22) Filed: Dec. 16, 2015

(65) Prior Publication Data

US 2017/0172294 A1 Jun. 22, 2017

(51) Int. Cl.
*A47B 37/00* (2006.01)
*H05B 1/02* (2006.01)

(52) U.S. Cl.
CPC ..... *A47B 37/00* (2013.01); *H05B 1/0294* (2013.01); *A47B 2220/0091* (2013.01)

(58) Field of Classification Search
CPC ..... H01L 21/67103; H05B 2203/037; H05B 2203/003
USPC ..... 219/444.1, 544
See application file for complete search history.

(56) References Cited

U.S. PATENT DOCUMENTS 2,471,884 A 5/1949 Monnot
3,111,569 A * 11/1963 Rubenstein ..... B28B 23/0006 52/223.14
3,420,981 A 1/1969 Martinet
3,617,693 A * 11/1971 Shimosawa ..... H05B 3/68 108/150
3,740,513 A * 6/1973 Peters, Jr. ..... A47B 77/08 219/218
3,876,202 A * 4/1975 Allison ..... A63D 15/00 108/156
3,904,847 A * 9/1975 Adams ..... E01C 11/265 219/213
4,088,115 A * 5/1978 Powell ..... F24D 11/007 126/647
4,559,881 A * 12/1985 Lankard ..... B28B 23/00 106/644
4,727,241 A * 2/1988 McWilliams ..... H05B 3/748 219/462.1
4,806,738 A * 2/1989 Telamo ..... A47J 27/004 219/218
4,899,027 A * 2/1990 Wong ..... A47B 31/02 219/218
5,077,460 A * 12/1991 Rocha ..... A47J 36/2483 219/217
5,138,138 A 8/1992 Theilacker et al.
(Continued)

OTHER PUBLICATIONS

Galanter & Jones, brochure for Heated Outdoor Furniture, 2015.

*Primary Examiner* — Ibrahime A Abraham
*Assistant Examiner* — Gyounghyun Bae
(74) *Attorney, Agent, or Firm* — Martin & Associates, LLC; Derek P. Martin

(57) ABSTRACT

Radiant furniture made of a concrete mix includes one or more heating elements or hot water supplied hydronic tubing that provide comfortable radiant heat. Tabletops can be heated to a temperature that is comfortable for people seated at the table. Other tabletops can be heated to a lower temperature for use in a greenhouse. Benches and seats can be heated to provide comfortable heated seating. Combinations can also be used together, such as a heated tabletop with heated seats. A controller senses the temperature of the furniture and the ambient temperature, then applies power to one or more heating elements in the furniture according to programmed temperature thresholds to provide comfortable radiant heat from the furniture.

14 Claims, 8 Drawing Sheets

(56) References Cited

U.S. PATENT DOCUMENTS 5,189,282 A * 2/1993 Rocha ..... A47J 36/2483 219/218
5,324,911 A 6/1994 Cranston et al.
5,467,695 A * 11/1995 Keller ..... A47J 37/0781 126/39 H
5,752,450 A * 5/1998 Roesner ..... A47B 83/02 108/161
6,065,466 A 5/2000 Baykal
6,302,094 B1 * 10/2001 Wehrly ..... A47C 7/744 126/204
6,653,607 B2 * 11/2003 Ellis ..... A61F 7/007 219/212
6,803,543 B2 10/2004 Argersinger et al.
6,914,221 B1 * 7/2005 Witt ..... A47J 36/04 219/218
6,933,469 B2 * 8/2005 Ellis ..... A61F 7/00 219/217
6,943,319 B2 * 9/2005 Jones ..... H05B 3/56 174/103
7,417,206 B2 * 8/2008 Nakamura ..... H01L 21/67103 219/444.1
9,593,858 B2 * 3/2017 Dellwig ..... F24D 19/1009
2004/0149718 A1 * 8/2004 Ito ..... H01L 21/67103 219/444.1
2007/0267399 A1 * 11/2007 Flores ..... A47B 13/00 219/218
2008/0000895 A1 * 1/2008 Herving ..... A47J 36/2483 219/620
2008/0110870 A1 * 5/2008 Mirkes ..... A47J 36/2483 219/218
2008/0245786 A1 * 10/2008 Sharma ..... H05B 3/347 219/529
2010/0107536 A1 * 5/2010 Tautari ..... B28B 7/0032 52/414
2010/0170422 A1 7/2010 Redmond et al.
2011/0174795 A1 * 7/2011 Chen ..... G05D 23/1917 219/201
2014/0034266 A1 * 2/2014 Tabei ..... B60H 1/00764 165/42
2014/0069908 A1 * 3/2014 Yang ..... F24D 13/02 219/213
2014/0333010 A1 * 11/2014 Ciuperca ..... E04G 9/10 264/338
2015/0069664 A1 * 3/2015 Ciuperca ..... B28B 7/0032 264/333

* cited by examiner

RADIANT FURNITURE

BACKGROUND

1. Technical Field

This disclosure generally relates to furniture, and more specifically relates to furniture that radiates heat.

2. Background Art

Many restaurants include outside seating. When the weather is cool or cold, portable space heaters are often used to keep the outside diners warm. For example, large, umbrella-shaped propane heaters are often used to keep the outside dining area warm when the temperature outside is cool or cold. A problem with these types of heaters is people closest to the heaters are often too warm and people a little farther away from the heaters are often too cold. This is because these heaters are designed to heat a given space, not specifically people within the space. In addition, these heaters can be expensive to run, hot to the touch and therefore a burn hazard, difficult to light, require periodic maintenance, etc. There exists a need for a heater that provides comfortable heat for people in a given space without the drawbacks mentioned above, in both commercial and home patio settings.

SUMMARY

Radiant furniture made of a concrete mix includes one or more heating elements or hot water supplied hydronic tubing that provide comfortable radiant heat. Tabletops can be heated to a temperature that is comfortable for people seated at the table. Other tabletops can be heated to a lower temperature for use in a greenhouse. Benches and seats can be heated to provide comfortable heated seating. Combinations can also be used together, such as a heated tabletop with heated seats. A controller senses the temperature of the furniture and the ambient temperature, then applies power to one or more heating elements in the furniture according to programmed temperature thresholds to provide comfortable radiant heat from the furniture.

The foregoing and other features and advantages will be apparent from the following more particular description, as illustrated in the accompanying drawings.

BRIEF DESCRIPTION OF THE DRAWING(S)

The disclosure will be described in conjunction with the appended drawings, where like designations denote like elements, and:

DETAILED DESCRIPTION

The disclosure and claims herein relate to radiant furniture made of a concrete mix that includes one or more heating elements or hot water supplied hydronic tubing that provide comfortable radiant heat. Tabletops can be heated to a temperature that is comfortable for people seated at the table. Other tabletops can be heated to a lower temperature for use in a greenhouse. Benches and seats can be heated to provide comfortable heated seating. Combinations can also be used together, such as a heated tabletop with heated seats. A controller senses the temperature of the furniture and the ambient temperature, then applies power to one or more heating elements in the furniture according to programmed temperature thresholds to provide comfortable radiant heat from the furniture.

Figure 1:
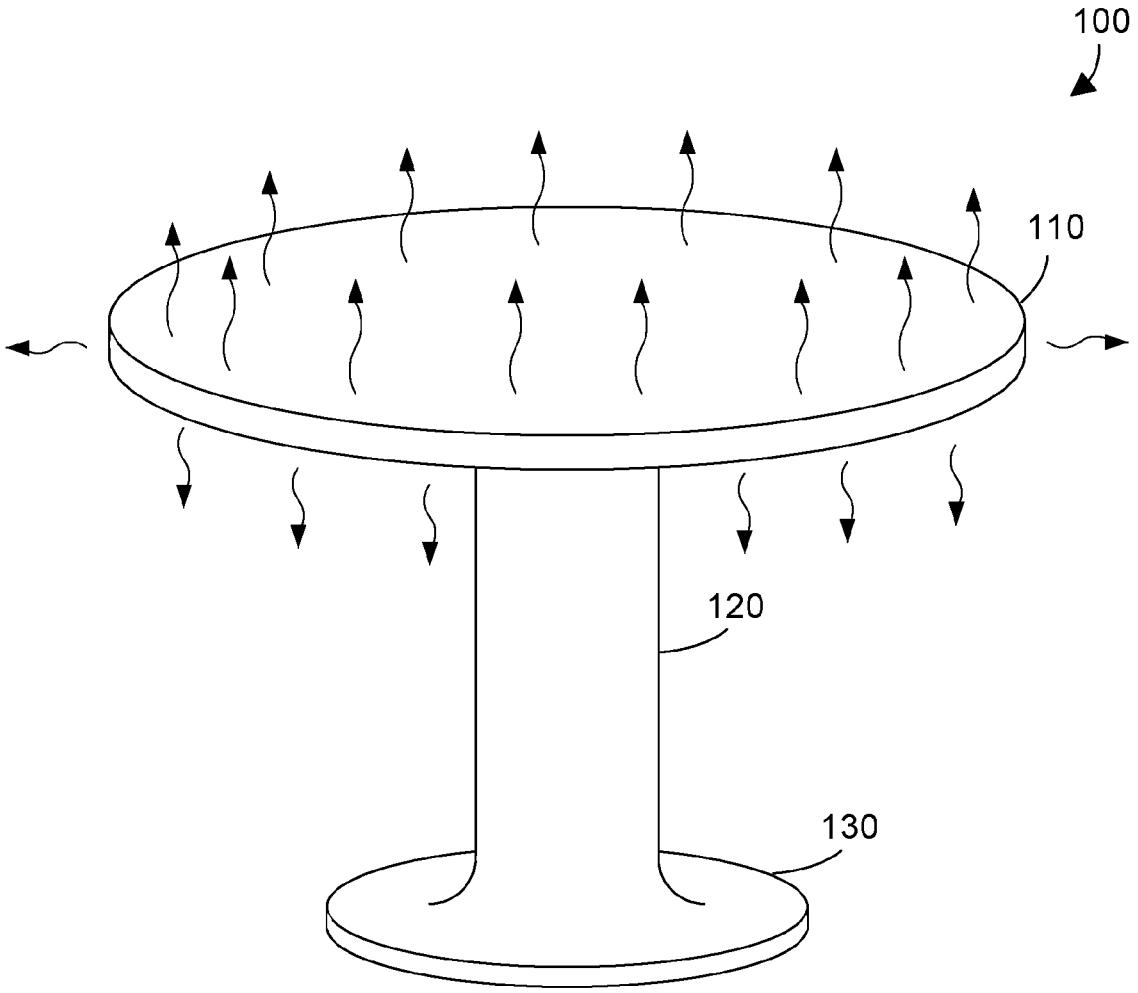
FIG. 1 is a perspective view of a table with a tabletop that radiates heat.

Referring to FIG. 1, a table 100 includes a radiant tabletop 110 that radiates heat in all directions, as shown by the arrows emanating from the tabletop 110. The tabletop 110 is connected to a support 120 that is connected to a base 130. Providing a radiant tabletop 110 allows a person seated at the table to maintain a comfortable temperature. If the person feels cold, the person can move closer to the tabletop 110 or lean over the tabletop 110 to take advantage of the heat radiating from the tabletop 110. If the person feels warm, the person can sit back in his or her chair farther away from the tabletop 110 to be farther away from the radiant tabletop 110. A table 100 with a radiant tabletop 110 thus allows a user to easily regulate the amount of heat they feel by moving closer to or farther from the radiant tabletop 110.

Radiant tabletop 110 is preferably made of a concrete-based mix. Concrete is a preferred material for radiating heat. The preferred mix is marketed under the brand name enCOUNTER, which is a specialized concrete-based mix generally used to make concrete kitchen countertops. This mix has a specified strength of 8,700 pounds per square inch (psi) (612 kg per square cm). The enCOUNTER, concrete-based mix provides heavy density, high strength radiant furniture with no warping or long-term cracking issues. Bags of enCOUNTER are 50 lb (22.7 kg), and are available in either gray or white. The white enCOUNTER mix has less coarse aggregate than the gray enCOUNTER mix. One suitable mix for the radiant furniture is:

50 lb (22.7 kg) enCOUNTER mix 82 to 90 fluid ounces (2.4 to 2.7 liters) water

Other ingredients could be added to the mix, including plasticizer and structural fiber. A suitable plasticizer is enFLOW plasticizer, and a suitable structural fiber is enFORCE. The enCOUNTER mix, enFLOW plasticizer and enFORCE fibers are all made by the same company as part of the enCOUNTER product line, and are available from Cimarron Wholesale in Oklahoma City, Okla. One suitable mix for the radiant furniture that includes the plasticizer and structural fiber is:

50 lb (22.7 kg) enCOUNTER mix
64 to 72 fluid ounces (1.9 to 2.1 liters) water
1 fluid ounce (0.03 liter) enFLOW plasticizer
2 dry ounces (60 grams) enFORCE structural fibers Other alternatives could be used instead of the enCOUNTER mix, including Xtreme Countertop available from SureCrete Design in Dade City, Fla.; Sakrete 5000 available from Bonsal American, Inc. in Charlotte, N.C.; and Cheng Pro-Formula Concrete Countertop Mix available from store.concreteexchange.com.

Of course, a suitable mix for the radiant furniture could be made without using one of the commercially-available mixes above. One suitable mix for the radiant furniture is:

10 lb (4.5 kg) portland cement
14 lb (6.4 kg) sand (or fine aggregate of several sizes)
12.5 lb (5.7 kg) course aggregate (such as white limestone)
2.5 to 4.8 lb (1.1 to 2.2 kg) water One suitable enhancement to the mix above is the addition of metakaolin, which is a dehydroxylated form of the clay mineral kaolinite. Metakaolin is generally considered a replacement for Portland cement, at a proportion of 8-20% of the weight of the cement. Metakaolin can increase both the compressive and flexural strength of concrete. A suitable mix for the radiant furniture that includes metakaolin is:

9 lb (4.1 kg) Portland cement
1 lb (0.5 kg) metakaolin
14 lb (6.4 kg) sand (or fine aggregate of several sizes)
12.5 lb (5.7 kg) course aggregate (such as white limestone)
2.5 to 4.8 lb (1.1 to 2.2 kg) water While several specific formulations of the concrete-based mix are disclosed above, one of ordinary skill in the art will realize that a suitable concrete-based mix can have ingredients with weights or proportions that vary from those disclosed above. For example, the weight or proportion of each ingredient could preferably vary by as much as 30% in accordance with the disclosure and claims herein. The weight or proportion of each ingredient could more preferably vary by as much as 20% in accordance with the disclosure and claims herein. The weight or proportion of each ingredient could still more preferably vary by as much as 10% in accordance with the disclosure and claims herein. And the specific weights and proportions disclosed above are the most preferred weights and proportions for the concrete-based mix.

The support 120 and base 130 could be made of any suitable material capable of structurally supporting the tabletop 110, including concrete, wood, or any other natural, synthetic or composite material. In one particular implementation, the support 120 and base 130 are made of the same concrete-based mix as the tabletop 110. To keep from losing heat, the tabletop 110 can be thermally insulated from the support 120. In the alternative, the tabletop 110 can be thermally coupled to support 120, which will allow heat to travel from the tabletop 110 into the top portion of the support 120.

A concrete-based mix is the preferred material for radiant tabletop 110 because a concrete-based mix can provide the thermal mass and heat conduction properties that work well when embedding heating elements in the concrete-based mix. In the most preferred implementation, the concrete mix is a high-strength concrete mix that has a compressive strength of at least 6,000 psi (422 kg per square cm). Note, however, that many other suitable materials could be used, including without limitation both natural and synthetic materials. For example, an epoxy resin or polyurethane could be used instead of a concrete-based mix, but may provide less heat conduction when compared to a concrete mix when they have less density than a concrete mix. The disclosure and claims herein expressly extend to the use of any suitable material for the heated surface of radiant furniture.

Figure 2:
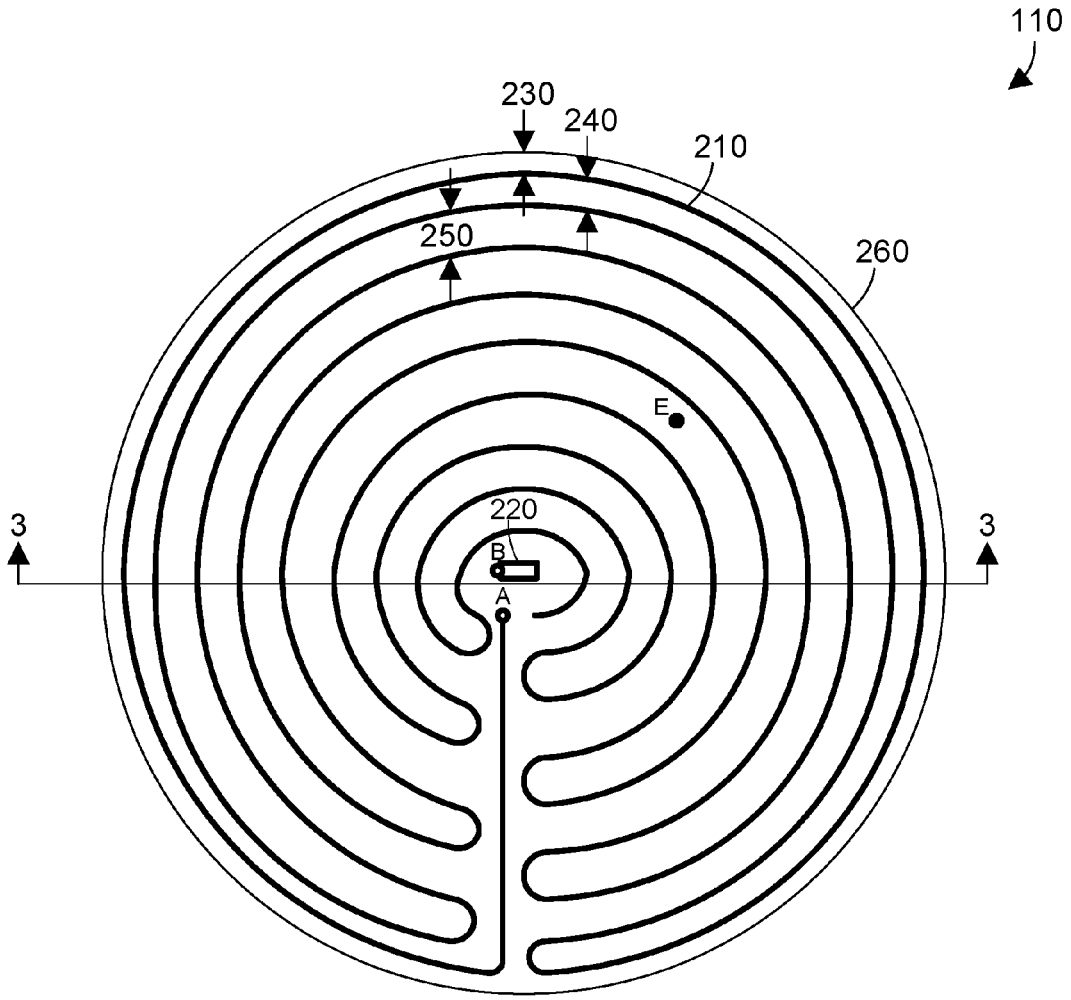
FIG. 2 is a bottom view of the tabletop shown in FIG. 1 showing a single heating element embedded within the concrete mix of the tabletop.

The radiant heat in the tabletop 110 is created by applying power to one or more heating elements embedded within the concrete mix of the tabletop 110. FIG. 2 shows a bottom view of the tabletop 110 without most of the concrete so the heating element 210 is visible. Heating element 210 is preferably a commercially-available heating cable that is manufactured by Watts Water Technologies in Springfield, Mo. as ProMelt model number SC50120008 for a 29 foot cable and SC50120053 for a 208 foot cable, with other lengths available in between these two lengths. This product is used for ice-melt applications in flatwork, so sidewalks, driveways, etc. can have snow or ice easily cleared by heating the heating cable embedded in the sidewalk or driveway. The heating element 210 is preferably designed for single-phase operation. Thus, for applications in the United States, the heating element 210 is preferably designed to be powered by a 120 volt alternating-current power source. Of course, other voltages could also be used, and two-phase or three-phase or direct-current (DC) power could also be used within the scope of the disclosure and claims herein. The specified minimum bend radius is one inch (25 mm). When the heating element is spaced at 3 in. (7.6 cm) centers, it is rated at 50 watts per square foot (540 watts per square meter). When spaced at 2 in. (5.1 cm) centers, it is rated for 75 watts per square foot (810 watts per square meter). The spacing of the heating element within the tabletop 210 can thus be varied to create different tabletops with different heating properties. For example, a table used in a greenhouse for sprouting plants may need to maintain a temperature of only 80 degrees Fahrenheit (27 degrees Celsius), while a table used in an outside area of a restaurant may need to maintain a temperature of 105 degrees Fahrenheit (41 degrees Celsius). Different tabletops could be designed with different spacing of the heating element, thereby providing a designed amount of heating based on the spacing of the heating element. Tabletops can also include multiple heating elements, as discussed in more detail below. The preferred heating element includes a foil shield, a braided copper ground plane, a high temperature covering for the two individual elements preferably made of Ethylene tetrafluoroethylene (ETFE), with the individual elements made of a low-oxygen copper alloy.

Variations other than the commercially-available heating cable from ProMelt referenced above can also be used. For example, while the ProMelt heating cable has a polyurethane outer jacket, this outer jacket is not needed for the radiant furniture disclosed herein. This polyurethane outer jacket is provided in the ProMelt heating cable to make the heating cable rugged enough to walk on after installation, which is typically done as concrete is poured over the heating cable in driveways and sidewalks. Because the heating cable in the tabletop disclosed herein need not be walked on, the polyurethane jacket can be omitted.

FIG. 2 shows the heating element 210 is one continuous coil, with a single point A that represents an exit point to tabletop 110 for electrical connections connected to the heating element 210. In the most preferred implementation, an electrical cable is connected to the heating element 210 at connection points that are embedded within the tabletop 110, with the cable passing out of the tabletop 110 at point A to be connected to a controller. In the most preferred implementation, heating element 210 includes two individual elements that are electrically insulated and run in parallel, and are suitably terminated a the far end opposite the electrical connections by electrically connecting the two. Applying power between the two connections to the heating element 210 results in turning on the heating element 210, while removing power between the two connections results in turning off the heating element 210. The outer-most run of the heating element 210 is preferably spaced relatively close to the outer edge 260 of the tabletop to provide effective heating right at the edge of the tabletop. In the most preferred implementation, the heating element 210 is placed at 0.5 inch (13 mm) from the outer edge 260 of the tabletop 110, or from the edge of other radiant furniture.

In the preferred implementation, the spacing between the runs of the heating element is closer together near the outer edge 260 of the tabletop 110 than it is farther towards the middle of the tabletop. Thus, a spacing 240 between the two outside runs of the heating element is less than the spacing 250 between the second and third runs of the heating element. Thus, the outside edge of the tabletop 110 could have a spacing of the heating element that provides 90 watts per square foot (970 watts per square meter), while the spacing of the heating element past the first two or three runs of the heating element could have a spacing of the heating element that provides a lower wattage per square foot, such as 75 watts per square foot (810 watts per square meter) or even 50 watts per square foot (540 watts per square meter). Providing a higher density of heating element in the outer edge is desirable because the outer edge loses heat more quickly than the interior of the tabletop 110. The higher density of heating element in the outer edge thus provides better heating performance by providing more heat at the exact location where more heat is lost from the tabletop. In addition, the outer edge of the tabletop is where a person sits, so the higher density of heating element in the outer edge provides more heat at the location where the person most benefits from it. In the most preferred implementation, the density of heating element 210 near the outer edge 260 of the tabletop 110 is preferably at least 20% greater than the density of heating element 210 at a midpoint between the outer edge 260 and the center of the table, shown in FIG. 2 as point E. Of course, the density of heating element 210 near the outer edge could be much more than 20% greater. For example, the density of heating element 210 near the outer edge 260 could be 100% greater, or twice the density, compared to a more interior portion like point E in FIG. 2. Thus, the heating element 210 could be spaced 1.5 inches (3.8 cm) apart for the first one or two runs, then could be spaced 3 in. (7.6 cm) apart for the more interior runs on the tabletop.

A temperature sensor 220 is preferably embedded in the tabletop 110 with point B representing an exit point for two electrical connections connected to the embedded temperature sensor 220. In the most preferred implementation, wires are connected to the temperature sensor, and the temperature sensor and connections are all embedded within the tabletop 110, with the wires exiting the tabletop 110 at point B for connection to a controller. One suitable implementation of the temperature sensor 220 is a thermistor, but any suitable temperature sensor could be used. One suitable thermistor is part number 1309007-044 manufactured by Ranco of Plain City, Ohio as part of the ETC family of electronic temperature controls, which is available from AllPoints Foodservice Parts & Supplies in Orlando, Fla. In addition, while the preferred implementation has the temperature sensor embedded within the concrete mix of the tabletop 110, the temperature sensor could instead be thermally coupled to the tabletop 110 without being embedded within the concrete mix of the tabletop 110. Furthermore, while the temperature sensor 220 is shown near the center of tabletop 110, it could instead be place at or near the outer edge 260 of tabletop 110 so it can more accurately measure temperature near a person seated at the table. The disclosure and claims herein expressly extend to any suitable location for the temperature sensor 220.

Figure 3:
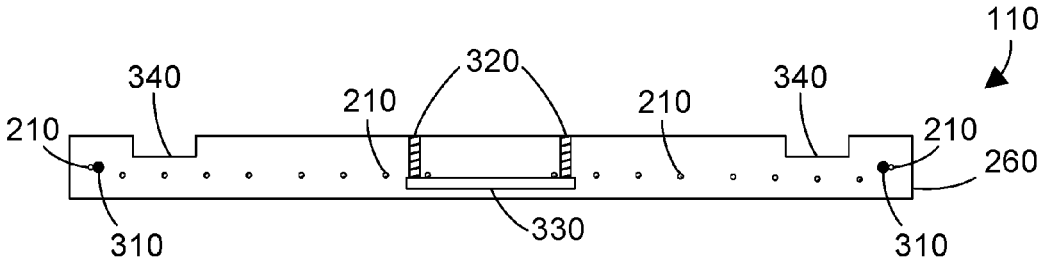
FIG. 3 is a cross-sectional view of the tabletop in FIG. 2 taken along the line 3-3.

FIG. 3 shows a cross-sectional view of the tabletop 110 in FIG. 2 taken along the lines 3-3. In this specific implementation, the tabletop 110 includes a reinforcing member 310, such as rebar. The reinforcing member 310 is placed near the outer edge 260 of the tabletop 110 to provide strength at the outer edge 260 of the tabletop 310. Note the outer run of the heating element 210 could be both mechanically and thermally coupled to the reinforcing member 310 to enhance the thermal transfer of heat from the heating element 210 to the concrete mix in the tabletop 110. Note the various runs of the heating element shown in FIG. 2 are represented in cross-section as small circles in FIG. 3, with some of these labeled 210 in FIG. 3.

A wire mesh not shown in FIG. 3 could be used in addition to or as the reinforcing member 310. The wire mesh could be a 2 inch×4 inch (5.1 cm×10 cm) or in a 4 inch×4 inch (10 cm×10 cm) wire mesh. Of course, other sizes of wire mesh could also be used. In addition to giving the tabletop additional structural strength, the wire mesh provides a support for attaching the heating element in the desired position so the heating element stays in the desired position while pouring the concrete mix. For example, the heating element could be attached to the wire mesh at various locations using wire ties.

The tabletop 110 preferably includes a structural support 330 embedded in the concrete mix that provides one or more attachment points for attaching a support for the tabletop 110. The structural support 330 is shown with threaded members 320 that provide anchors for attaching the support 120 to the tabletop 110 using a plurality of bolts. The structural support 330 could be, for example, a metal bracket with metal threaded members 320 attached to the metal bracket using bolts or welds. Once embedded in the concrete mix of the tabletop 110, the structural support 330 becomes a solid anchor point for attaching the support 120 to the tabletop 110.

One can appreciate from the cross-sectional view of the tabletop 110 in FIG. 3 how this tabletop 110 can be formed of a concrete mix. A circular form that has a bottom and sides can be used. A circular ring of rebar or other reinforcing member 310 could be installed near the outer edge of the form. The heating element 210 and temperature sensor 220 can be installed within the form as shown in FIG. 2. The heating element 210 could be structurally and thermally coupled to the reinforcing member 310 using wire zip ties, or other attachments. The heating element 210 could be spaced from the bottom and sides of the form and from different runs of itself using any suitable spacer, such as plastic spacers. The structural support 330 is also placed within the form, and may be spaced from the bottom of the form using one or more suitable spacers, such as plastic spacers. A decorative material such as aggregate or glass may be placed at the bottom of the form. In the alternative, no decorative material is used. Concrete is then poured into the form, which flows around the heating element 210 and structural support 330 to the bottom of the form until the form is filled. A circular spacer could be used to create the indentions 340 shown in FIG. 3 by embedding the circular spacer into the wet concrete. The form may then be vibrated to eliminate all bubbles and voids in the concrete mix. The concrete is then left in the form to harden. When the concrete is removed from the form, it has the cross-sectional appearance shown in FIG. 3. Making the tabletop out of a concrete mix allows numerous known techniques for decorative concrete to be used. For example, decorative material could be placed at the bottom of the form, which produces a tabletop with the decorative material on the top of the tabletop. The concrete surface of the tabletop could also be ground or stained to achieve a decorative look. Proper decorative techniques can produce tabletops that appear to be made of granite, marble or other stone. The disclosure and claims herein expressly extend to any and all finishes and looks that could be put on radiant furniture.

Figure 4:
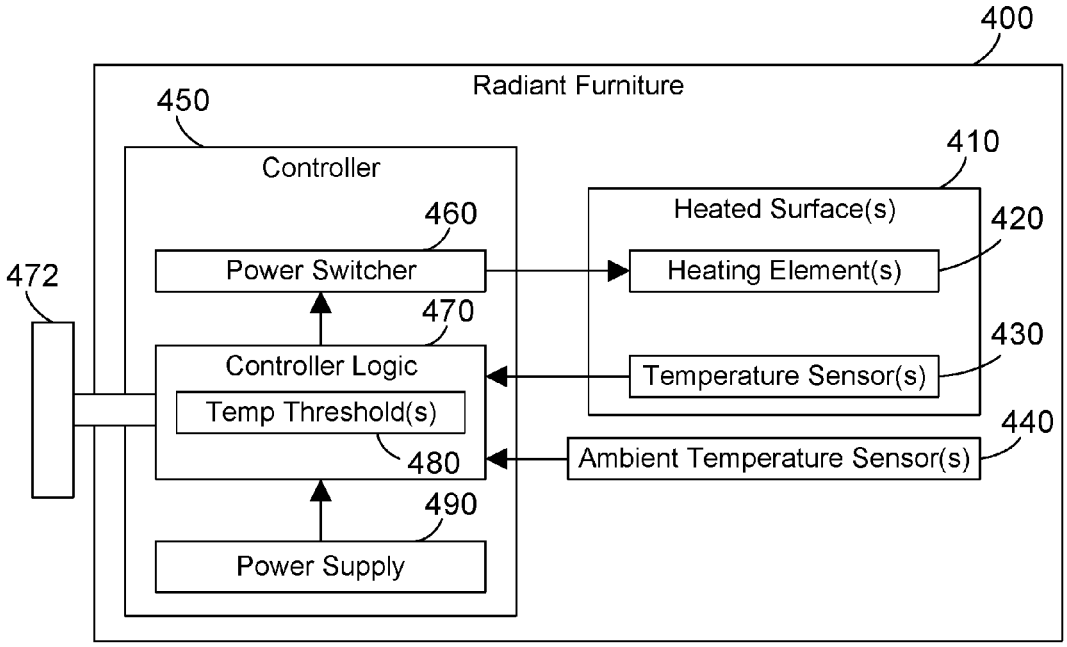
FIG. 4 is a block diagram of radiant furniture that uses electric heating elements.

Referring to FIG. 4, a block diagram shows various components of radiant furniture 400. Table 100 shown in FIGS. 1-3 is one suitable example of radiant furniture 400. Radiant furniture 400 includes one or more heated surfaces 410 that preferably include one or more heating elements 420 and one or more temperature sensors 430. The radiant furniture 400 also includes a controller 450 that includes a power switcher 460, controller logic 470 and a power supply 490. The power switcher 460 is any suitable means for applying power to the heating element(s) 420. One suitable implementation for power switcher 460 is a relay that selectively applies power to or removes power from the heating element(s) 420 under control of the controller logic 470. Another suitable implementation for power switcher 460 is a power transistor. The controller logic 470 includes one or more temperature threshold(s) 480 that determine when the controller logic 470 activates the power switcher 460 to apply power to the heating element(s) 420, and deactivates the power switcher 460 to remove power from the heating element(s) 420. The power supply 490 preferably provides power for the controller logic 470 as well as power routed through the power switcher 460 to the heating element(s) 420. The radiant furniture 400 may optionally include a knob 472 or other control that allows a user to adjust the temperature threshold(s) 480 to vary the heat produced by the radiant furniture 400 according to the user's preference. For example, in one suitable implementation, turning the knob 472 all the way in one direction will increase the temperature threshold(s) 480 to be four degrees warmer, while turning the knob 472 all the way in the opposite direction will decrease the temperature threshold(s) 480 to be four degrees cooler. Of course, any suitable adjustment mechanism could be used to allow a user of the radiant furniture to adjust the temperature threshold(s) 480 by any suitable amount. Suitable adjustment mechanisms include without limitation knobs, push-buttons, a membrane keypad, a remote control, etc.

Controller 450 can control a single heated surface 410. Controller 450 can also control multiple heated surfaces 410, either within a single piece of radiant furniture or across multiple pieces of radiant furniture. FIG. 4 shows heated surface(s) 410 with heating element(s) 420 and temperature sensor(s) 430 to represent that controller 450 can control multiple heated surfaces in one piece of radiant furniture (such as a picnic tabletop and bench seats) or multiple heated surfaces in multiple pieces of radiant furniture (such as multiple tables at a restaurant).

One suitable implementation of controller 450 is commercially-available controller made by Ranco of Plain City, Ohio as part number ETC-141000-000. This is a NEMA type 4× microprocessor-based electronic temperature controller. This controller allows setting the unit for Fahrenheit or Celsius scale, allows setting a Setpoint Temperature (which corresponds to a temperature threshold as disclosed herein), allows for setting a differential temperature to determine at what temperature the controller turns on power after turning off power when the Setpoint Temperature is reached, and allows setting the unit for cooling or heating mode. Of course, many other controllers, both commercially-available and custom-made, could also be used within the scope of the disclosure and claims herein.

Figure 5:
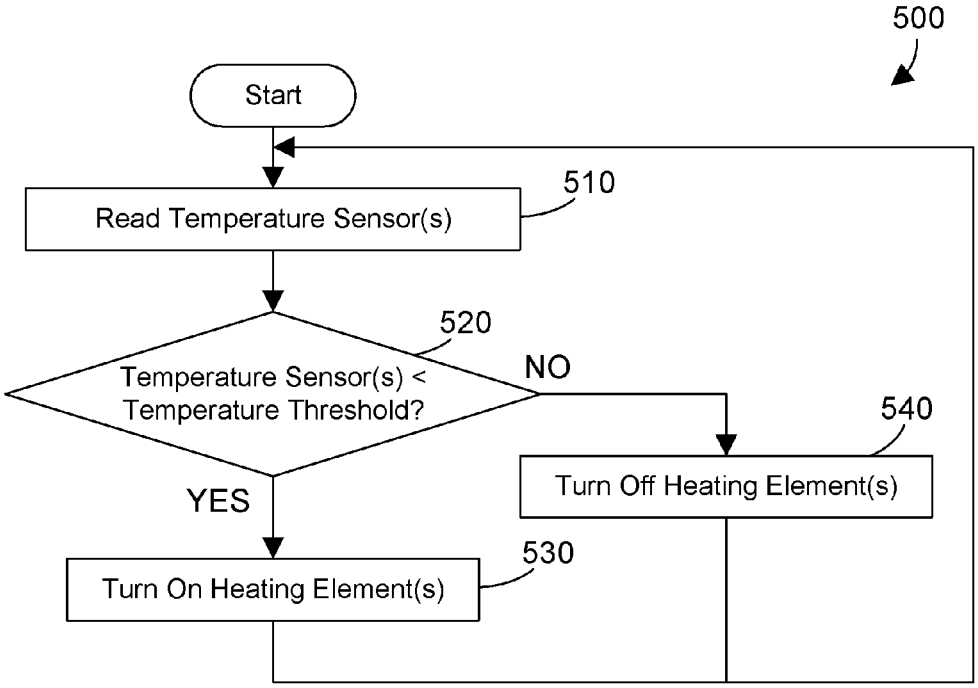
FIG. 5 is a flow diagram of a method for a controller to control radiant furniture that includes a single heating element, such as the tabletop shown in FIGS. 1-3.

FIG. 5 shows one suitable method 500 for the controller 400 to function for radiant furniture that includes one heating element, such as table 100 shown in FIGS. 1-3. The temperature sensor(s) are read (step 510). The temperature sensor(s) read in step 510 are temperature sensors 430 that sense the temperature of the heated surface(s) 410. When the temperature sensor senses a temperature of the heated surface 410 that is less than a defined temperature threshold (step 520=YES), the controller turns on the heating element(s) (step 530). Turning on the heating element(s) means the controller activates the power switcher 460 to apply power to the heating element(s) 420. When the temperature sensor senses a temperature of the heated surface 410 that is not less than the temperature threshold (step 520=NO), the controller turns off the heating element(s) (step 540). Method 500 thus turns on the heating element(s) when the temperature of the heated surface is less than a desired threshold temperature, and turns off the heating element(s) when the temperature is at or above the desired threshold temperature, thereby keeping the temperature of the heated surface near the desired threshold temperature.

Figure 6:
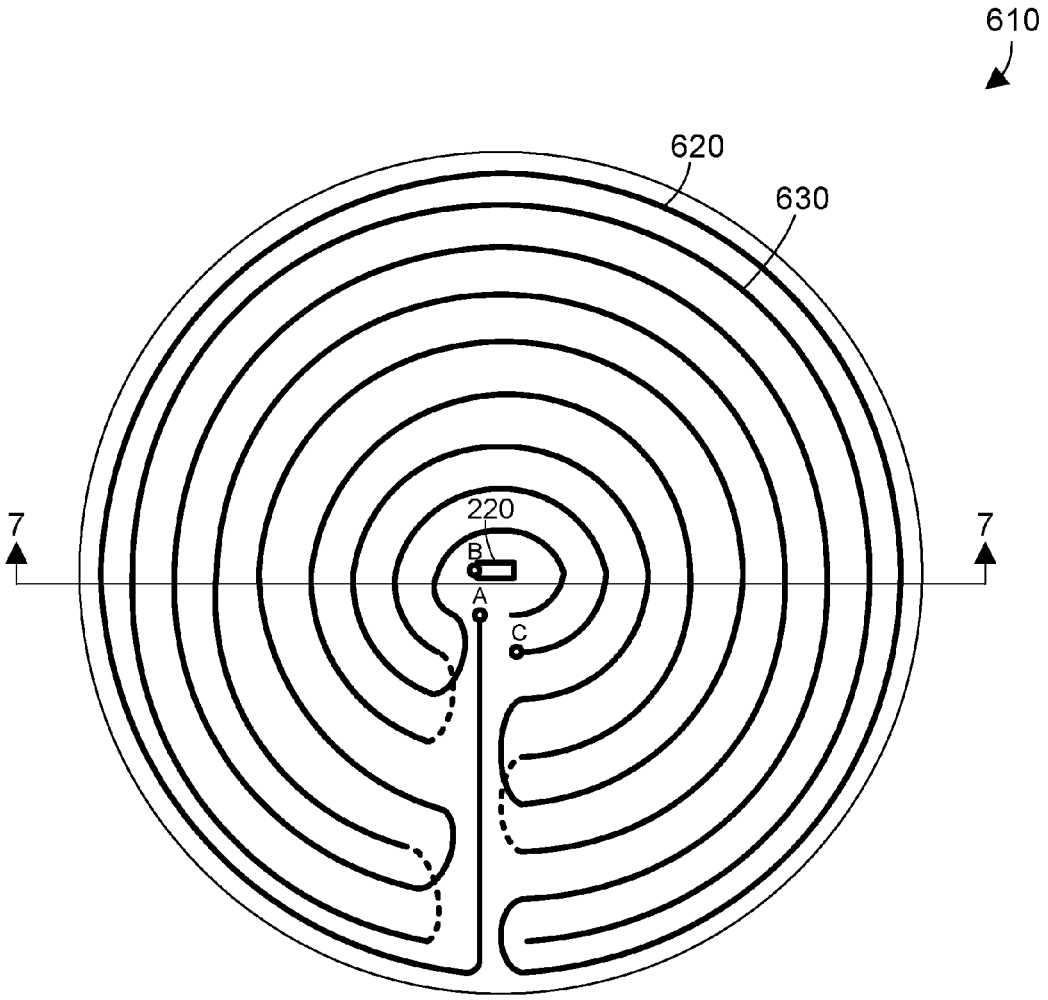
FIG. 6 is a bottom view of a second embodiment for the tabletop shown in FIG. 1 showing two heating elements embedded within the concrete mix of the tabletop.
Figure 7:
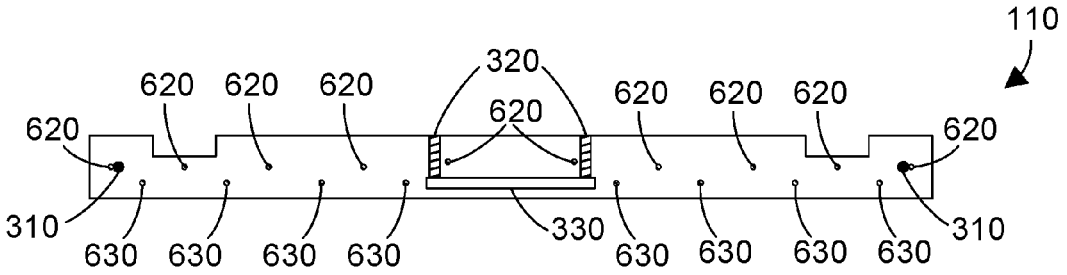
FIG. 7 is a cross-sectional view of the tabletop in FIG. 6 taken along the line 7-7.

Radiant furniture as disclosed herein can include multiple heating elements. The multiple heating elements can be turned on and off at the same time. In the alternative, the multiple heating elements can be turned on and off independently. Referring to FIG. 6, a tabletop 610 represents a second embodiment for the tabletop 110 shown in FIG. 1. The tabletop 610 includes two separate elements, a first 620 with electrical connections that exit the tabletop 610 at point A, and a second 630 with electrical connections that exit the tabletop at point C. Note these two separate elements 620 and 630 are interleaved with each other. The second heating element 630 has portions that are shown in dotted lines where it crosses the first heating element 620 to make it clear which runs are connected together. The two heating elements 620 and 630 can cross without touching when the heating elements are placed at different levels in the tabletop, as shown in FIG. 7. The first heating element 620 is placed at an upper position shown in FIG. 7 while the second heating element 630 is placed at a lower position in FIG. 7, thereby allowing them to cross without touching. Providing two heating elements that can be independently turned on or off by the controller allows greater versatility in how the tabletop 610 is used. For example, during weather that is slightly cool, turning on only the first heating element might provide the desired level of heating. For much colder weather, such as outside tables used at ski resorts, turning on both heating elements might be required to achieve the desired temperature.

Figure 8:
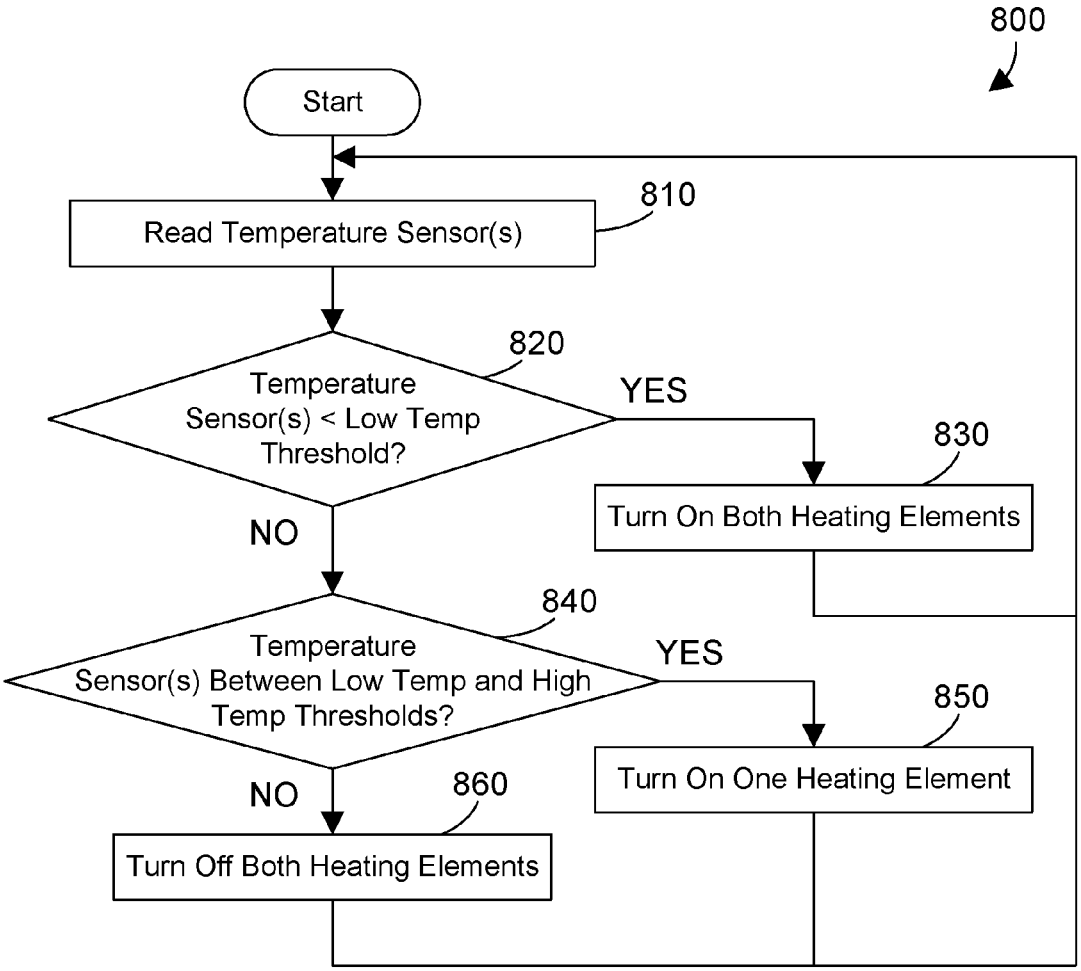
FIG. 8 is a flow diagram of a method for a controller to control radiant furniture that includes two heating elements, such as the tabletop shown in FIGS. 6-7.

Multiple heating elements can have different threshold temperatures that allow them to be independently controlled by the controller. Referring to FIG. 8, method 800 represents functions of the controller 450 shown in FIG. 4 when driving two heating elements independently. The temperature sensor(s) are read (step 810). The temperature sensors read in step 810 are the temperature sensor(s) 430 that sense the temperature of the heated surface(s) 410. When the temperature sensor senses a temperature of the heated surface(s)

410 lower than a low temperature threshold (step 820=YES), both heating elements are turned on (step 830). When the temperature sensor(s) sense a temperature of the heated surface(s) 410 that is not less than the low temperature threshold (step 820=NO), but sense a temperature that is between the low temperature threshold and a high temperature threshold (step 840=YES), only one of the two heating elements is turned on (step 850), while the other is turned off. When the temperature sensor senses a temperature of the heated surface(s) 410 that is not less than the low temperature threshold (step 820=NO) and that is not between the lower temperature threshold and the high temperature threshold (step 840=YES), this means the temperature of the heated surface(s) 410 is at or above the high temperature threshold, so both heating elements are turned off (step 860). A simple example will illustrate. Let's assume a radiant table is used as an outside table for a ski resort, where the ambient temperature can be very cold. Let's further assume a high temperature threshold of 100 degrees Fahrenheit (38 degrees Celsius), which is the desired temperature for the tabletop. A low temperature threshold of 80 degrees Fahrenheit (27 degrees Celsius) could be specified, so that when the table is first warming up after being turned on, both heating elements are turned on to bring the tabletop to 80 degrees Fahrenheit (27 degrees Celsius) as quickly as possible. Once the tabletop reaches 80 degrees Fahrenheit (27 degrees Celsius), one of the two heating elements would be turned off, with the remaining heating element remaining turned on until the tabletop reaches the 100 degree Fahrenheit (38 degrees Celsius) desired operating temperature (upper temperature threshold). Note that on very cold days, the one heating element may be insufficient to warm the tabletop from the 80 degree Fahrenheit (27 degrees Celsius) low temperature threshold to the 100 degree Fahrenheit (38 degrees Celsius) upper temperature threshold. The controller logic 470 in the controller 450 could include programming or logic that could measure temperature rise of the radiant furniture over time. Thus, if the tabletop achieves a temperature of 80 degrees Fahrenheit (27 degrees Celsius) in 30 minutes, but after another 30 minutes the temperature of the tabletop using only one heating element is only 85 degrees Fahrenheit (29 degrees Celsius), the controller can recognize the one heating element is insufficient to achieve the 100 degree Fahrenheit (38 degrees Celsius) upper temperature threshold, and can then turn on both heating elements until the 100 degree Fahrenheit (38 degrees Celsius) upper temperature threshold is reached. Because the controller 450 also has access to one or more ambient temperature sensors 440, the controller can alter its function according to ambient temperature. For example, the controller 450 could be programmed to turn on a single heating element between the low temperature threshold and upper temperature threshold when the ambient temperature is above 55 degrees Fahrenheit (13 degrees Celsius), but to turn on two heading elements when the ambient temperature is less than 55 degrees Fahrenheit (13 degrees Celsius). Of course, any suitable number of heating elements, temperature sensors, and ambient temperature sensors could be used. For example, four different heating elements could be used in a single heated surface, with the controller independently driving the four heating elements according to defined temperature thresholds. A heated surface 410 could include multiple temperature sensors 430, where the controller takes readings from the multiple temperature sensors 430 and computes an average temperature reading. In another variation, one controller 450 could control different heated surfaces that each has one or more heating elements. For example, a picnic table could have a heated tabletop and heated bench seats, and controller 450 could independently control the heating elements in both benches to achieve a desired heat level for the benches, while independently controlling the heating element in the tabletop to a different temperature threshold. In addition, multiple controllers could be used to control different heated surfaces. Thus, for the example above, with a picnic table with a heated tabletop and two heated bench seats, three different controllers could be used, one for the tabletop and two for the two heated bench seats. The disclosure and claims herein expressly extend to any suitable number of controllers, heating elements and temperature sensors in radiant furniture.

Figure 9:
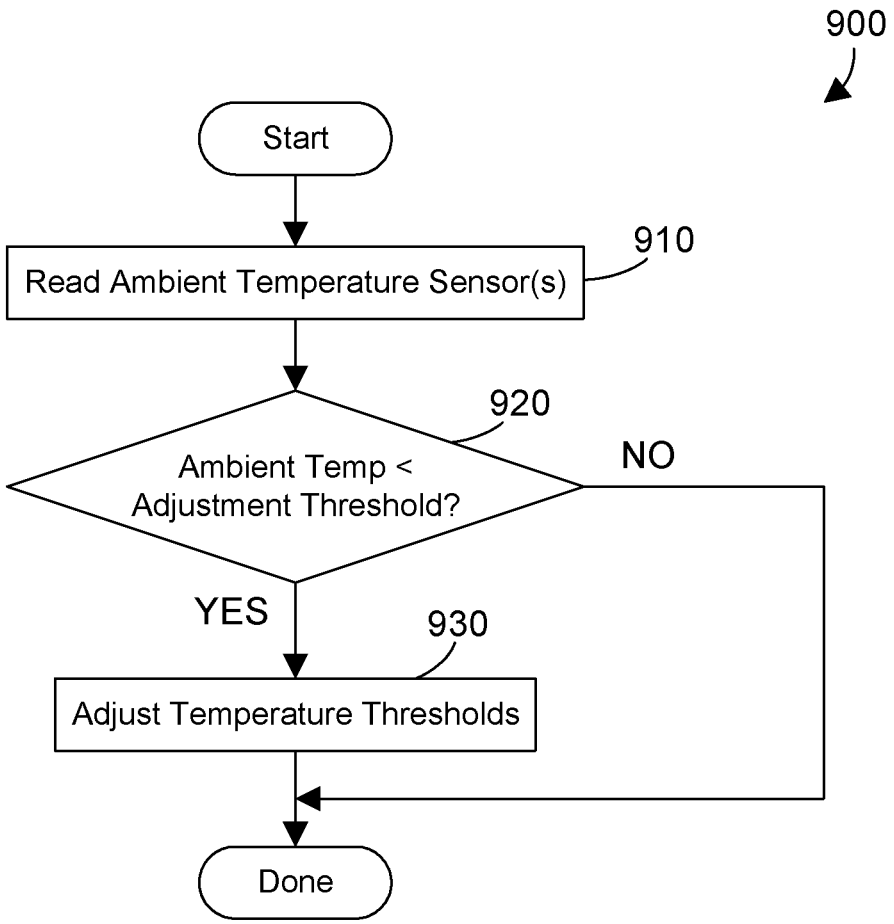
FIG. 9 is a flow diagram of a method for adjusting temperature thresholds when ambient temperature is below a specified adjustment threshold.

Because the controller 450 in FIG. 4 can measure the temperature of ambient air using one or more ambient temperature sensors 440, the controller 450 can take the ambient air temperature into account when controlling the heating elements in the heated surfaces. Referring to FIG. 9, method 900 shows one suitable adjustment the controller could make based on ambient temperature. We assume an adjustment threshold is defined in the controller. The ambient temperature sensor(s) are read (step 910). When the ambient temperature is less than the ambient threshold (step 920=YES), the temperature thresholds in the controller are adjusted (step 930). When the ambient temperature is not less than the ambient threshold (step 920=NO), method 900 is done. Method 900 thus illustrates a very simply way for the controller to take ambient air temperature into account, and to vary the temperature thresholds according to ambient air temperature. Thus, using the example of an outside table at a ski resort, the controller could adjust the temperature thresholds when the weather gets very cold to provide more heat to the heated tabletop.

Figure 10:
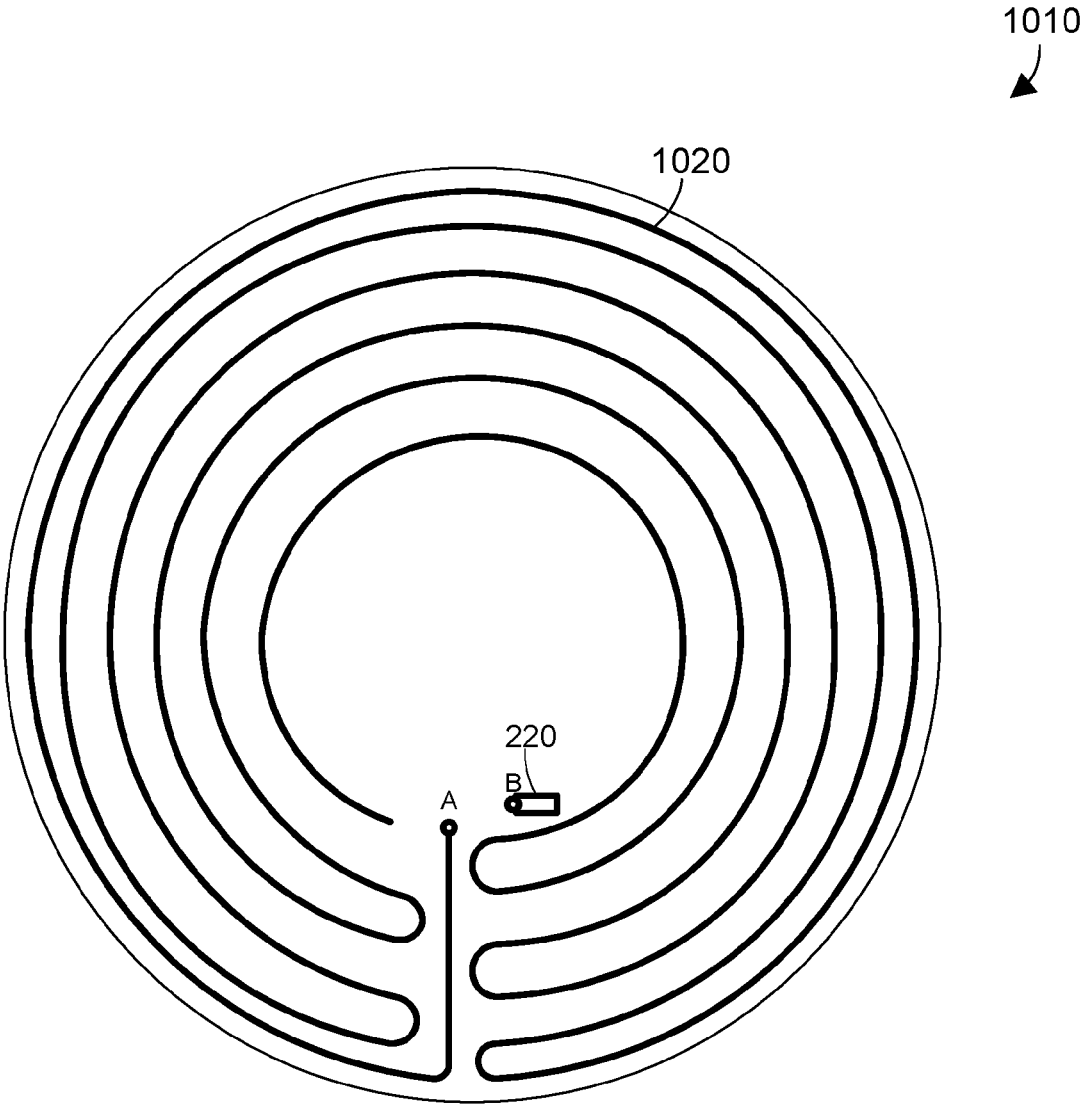
FIG. 10 is a bottom view of a third embodiment for the tabletop shown in FIG. 1 showing a heating element embedded within the concrete mix of the tabletop with the center of the tabletop not having any heating element.

It is also within the scope of the disclosure and claims herein to provide a heated surface where only part of the surface is heated. Referring to FIG. 10, a tabletop 1010 represents an alternative suitable implementation for the tabletop 110 shown in FIG. 1. In this implementation, the heating element 1020 does not extend to the center of the tabletop 1010. This allows the center of the tabletop 1010 to be cooler than the outside portion that has the heating element 1020. Point A is an exit point for electrical connections to the heating element 1020, and point B is an exit point for electrical connections to the temperature sensor 220. Note the temperature sensor 220 has been moved from the center of the table to a position closer to the heating element 1020, since the center of the table does not include any heating element. Thus, a person dining at an outside table on a cool evening could enjoy the heat of the tabletop 1020 while placing their iced beverage towards the center of the tabletop 1010 so the heat will not warm their drink and melt the ice in the beverage to the same extent as would happen if the person were to place the drink on the part of the table that includes the heating element 1020.

While electrical heating elements are discussed above, radiant furniture could instead be made using hot water supplied hydronic tubing, where hot water is pumped through heating tubes (water pipes) embedded in the concrete-based mix of the table. Thus, heating element 210 in FIGS. 2 and 3, heating elements 620 and 630 in FIGS. 6 and 7, and heating element 1020 in FIG. 10 could all be replaced by suitable heating tubes that carry hot water. Note that when using heating tubes, it will be required to make a connection to both ends of the heating tube so the hot water can flow from one end to the other. Suitable heating tubes include any type of known pipe, including metal pipe such as copper tubing, polyvinyl chloride (PVC) pipe, PEX tubing, rubber tubing such as Delta-Tube SD available from Delta T Solutions in San Marcos, Calif., etc. Any suitable heating tube that is capable of carrying hot water can be used.

Figure 11:
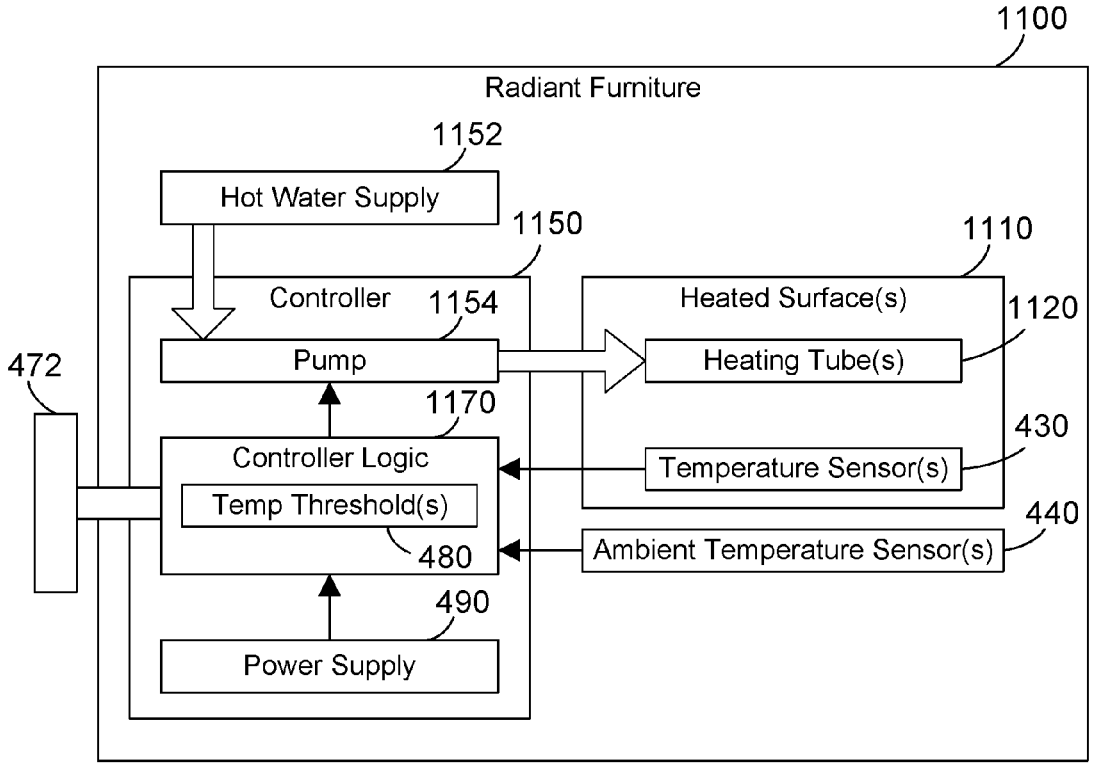
FIG. 11 is a block diagram of radiant furniture that uses heating tubes through which hot water is circulated.

FIG. 11 shows another example of radiant furniture 1100 that is heated with hot water. The heated surface(s) 1110 include one or more heating tube(s) 1120. The temperature sensor(s) 420 and ambient temperature sensor(s) 440 could be the same as used in the radiant furniture 400 shown in FIG. 4. The controller 1170 uses the temperature threshold(s) 480 to activate a pump 1154 that pumps hot water from a hot water supply 1152 through the heating tubes 1120. The hot water supply can be any suitable hot water supply, including a water heater with a tank, a tankless water heater, or any other suitable source of hot water. The power supply 490 and adjustment mechanism 472 could be the same as used for the electric configuration shown in FIG. 4.

While a circular table is shown in the drawings as one suitable example of radiant furniture, the disclosure and claims herein expressly extend to any suitable furniture piece with a heated surface in any suitable shape or size. For example, square, rectangular, oval, or other shaped tables are radiant furniture as disclosed herein. Picnic tables and bench seats are radiant furniture as disclosed herein. Chair backs and chair seats are radiant furniture as disclosed herein. One skilled in the art will realize that virtually any piece of furniture could be made with a heated surface, and could thus be radiant furniture as disclosed herein.

Radiant furniture as disclosed herein has many advantages when compared to propane space heaters. The cost of heating using radiant furniture is significantly less than the cost of burning propane in propane space heaters. Radiant furniture provides very comfortable heat right where it is needed, thereby providing more uniform heat and avoiding having some people too hot and others too cold, which is common for propane space heaters. In addition, propane space heaters burn propane, and the burning typically causes very hot surfaces that are a burn hazard. Electric space heaters have most of the same burn hazards and utilize extremely high wattage. Radiant furniture, on the other hand, is comfortably warm without ever creating a burn hazard. Propane space heaters can be difficult to light, and both propane and electric space heaters typically require periodic maintenance, such as changing out the propane tank, cleaning the heater, replacing elements, etc. Radiant furniture, in contrast, requires virtually no periodic maintenance. Radiant furniture as disclosed and claimed herein therefore provides a heating solution that is vastly superior to known propane or electric space heaters for the many reasons discussed above.

Radiant furniture made of a concrete mix includes one or more heating elements or hot water supplied hydronic tubing that provide comfortable radiant heat. Tabletops can be heated to a temperature that is comfortable for people seated at the table in a cool or cold outdoor setting. Other tabletops can be heated to a lower temperature for use in a greenhouse or at an indoor location requiring a warm table, such as in a restaurant with the air conditioning set to a cold setting. Benches and seats can be heated to provide comfortable heated seating. Combinations can also be used together, such as a heated tabletop with heated seats. A controller senses the temperature of the furniture and the ambient temperature, then applies power to one or more heating elements in the furniture according to programmed temperature thresholds to provide comfortable radiant heat from the furniture.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

The invention claimed is:

1. A table comprising:

(A) a tabletop comprising:

a concrete-based mix that provides a structure for the tabletop;

an inner portion of the tabletop that does not include any heating element;

an outer portion of the tabletop that comprises a first conduction heating element embedded in the concrete-based mix, wherein the first conduction heating element has a first run located at a predetermined distance from an outer edge of the tabletop around a perimeter of the tabletop, and a second run extending from the first run and located at a predetermined distance from the first run farther away from the outer edge of the tabletop; and a first temperature sensor embedded in the concrete-based mix in the outer portion of the tabletop that determines temperature of the outer portion of the tabletop;

(B) a controller coupled to a power source, to the first conduction heating element, and to the first temperature sensor, wherein the controller determines from the first temperature sensor when the temperature of the outer portion is less than a first temperature threshold, and in response, applies power to the first conduction heating element, and when the temperature of the outer portion is not less than the first temperature threshold, removes the power from the first conduction heating element;

(C) a second temperature sensor coupled to the controller, wherein the second temperature sensor determines temperature of ambient air; and (D) controller logic in the controller that detects from the second temperature sensor when the temperature of the ambient air is below a defined adjustment temperature threshold, and in response, increases the first temperature threshold.

2. The table of claim 1 further comprising:

a second conduction heating element coupled to the controller and embedded in the concrete-based mix of the outer portion;

wherein the controller determines from the first temperature sensor when the temperature of the outer portion is less than a second temperature threshold, and in response, applies the power to the first and second conduction heating elements, and when the temperature of the outer portion is between the first temperature threshold and the second temperature threshold, applies the power to the second conduction heating element and removes the power from the first conduction heating element.

3. The table of claim 1 wherein density of the first conduction heating element near the outer edge of the outer portion is at least 20% greater than the density of the first conduction heating element at a point halfway between a middle point and the outer edge of the outer portion.

4. The table of claim 3 wherein the density of the first conduction heating element is a function of spacing between runs of the first conduction heating element.

5. The table of claim 3 further comprising a reinforcing member embedded in the concrete-based mix of the outer portion.

6. The table of claim 5 wherein the first conduction heating element is coupled to the reinforcing member near the outer edge of the outer portion.

7. The table of claim 1 further comprising a structural support embedded in the concrete-based mix of the tabletop that provides at least one attachment point for attaching a support for the table.

8. The table of claim 7 wherein the support comprises at least one leg attached to the structural support and supporting the tabletop.

9. The table of claim 1 wherein the first conduction heating element is spaced at the predetermined distance from the outer edge of the tabletop to provide desired radiant heating of the outer portion.

10. The table of claim 1 further comprising a temperature adjuster that allows a user of the table to adjust the first temperature threshold.

11. A table comprising:

(A) a heated tabletop comprising:

a concrete-based mix with a compressive strength of at least 6,000 pounds per square inch;

a first conduction heating element embedded in the concrete-based mix;

a reinforcing member embedded in the concrete-based mix of the heated tabletop near an outer edge of the heated tabletop, wherein the first conduction heating element is coupled to the reinforcing member near the outer edge of the heated tabletop;

wherein density of the first conduction heating element near the outer edge of the heated tabletop is at least 20% greater than the density of the first conduction heating element at a point halfway between a middle point and the outer edge of the heated tabletop, wherein the density of the first conduction heating element is a function of spacing between runs of the first conduction heating element; and a first temperature sensor embedded in the concrete-based mix of the heated tabletop that determines temperature of the heated tabletop;

(B) a second temperature sensor that determines temperature of ambient air;

(C) a controller coupled to a power source, to the first conduction heating element, to the first temperature sensor, and to the second temperature sensor, wherein the controller comprises:

a first temperature threshold;

an adjustment temperature threshold;

controller logic that determines from the first temperature sensor when the temperature of the heated tabletop is less than the first temperature threshold, and in response, applies power to the first heating element, and when the temperature of the heated tabletop is not less than the first temperature threshold, removes the power from the first conduction heating element, wherein the controller logic detects from the second temperature sensor when the temperature of the ambient air is below the adjustment temperature threshold, and in response, raises the first temperature threshold.

12. The table of claim 11 wherein the first conduction heating element is spaced at a first distance from the outer edge of the heated tabletop to provide desired radiant heating of the heated tabletop.

13. The table of claim 12 further comprising a defined area of the heated tabletop that has no heating element within the first distance of the first conduction heating element.

14. The table of claim 13 wherein the defined area of the heated tabletop comprises a middle portion of the heated tabletop.

* * * * *